US009073189B2

(12) United States Patent
Chen

(10) Patent No.: US 9,073,189 B2
(45) Date of Patent: Jul. 7, 2015

(54) ADAPTER STRUCTURE FOR HANDHELD ELECTRIC TOOLS

(71) Applicant: Hsiu-Mei Chen, Kaohsiung (TW)

(72) Inventor: Hsiu-Mei Chen, Kaohsiung (TW)

( * ) Notice: Subject to any disclaimer, the term of this patent is extended or adjusted under 35 U.S.C. 154(b) by 0 days.

(21) Appl. No.: 14/450,523

(22) Filed: Aug. 4, 2014

(65) Prior Publication Data

US 2015/0151416 A1 Jun. 4, 2015

(30) Foreign Application Priority Data

Dec. 3, 2013 (TW) ..... 102222636 U

(51) Int. Cl.
*B25B 13/58* (2006.01)
*B25B 23/00* (2006.01)
*B25B 21/00* (2006.01)

(52) U.S. Cl.
CPC ..... *B25B 23/0035* (2013.01); *B25B 21/007* (2013.01)

(58) Field of Classification Search
CPC B25B 23/00; B25B 23/0007; B25B 23/0035; B25B 23/0042; B25B 13/08; B25B 13/48; B25B 21/007; B25B 15/001
USPC ..... 81/180.1, 185, 451–453, 439, 429, 81/DIG. 11, 124.4, 474, 475, 125; 279/22, 279/79, 128, 145
See application file for complete search history.

(56) References Cited

U.S. PATENT DOCUMENTS

| | | | | |
|---|---|---|---|---|
| 7,032,481 | B2 * | 4/2006 | Li et al. | 81/429 |
| 7,387,051 | B1 * | 6/2008 | Chiang | 81/124.4 |
| 2009/0255386 | A1 * | 10/2009 | Liao | 81/474 |
| 2011/0056341 | A1 * | 3/2011 | Lai | 81/475 |
| 2011/0209588 | A1 * | 9/2011 | Tsai | 81/125 |

* cited by examiner

*Primary Examiner* — Monica Carter
*Assistant Examiner* — Melanie Alexander
(74) *Attorney, Agent, or Firm* — Alan D. Kamrath; Kamrath IP Lawfirm, P.A.

(57) ABSTRACT

An adapter structure for handheld electrical tools is disclosed, which includes an outer socket and an inner socket. The outer socket is provided with a shank at its bottom and provided therein with first teeth. The inner socket has an upper section, a middle section, and a lower section. The middle section is provided at its bottom with second teeth. The inner socket is fitted into the outer socket and limited by a crimp formed at a top edge of the outer socket, so that the inner socket will not be detached from the outer socket. When a selective tool, fitted at the upper section, is pressed to move downwardly, the first teeth can engage with the second teeth, so that the outer socket can drive the inner socket with the selective tool to rotate bolts or nuts under torque limitation for fastening operations.

4 Claims, 5 Drawing Sheets

ADAPTER STRUCTURE FOR HANDHELD ELECTRIC TOOLS

BACKGROUND OF THE INVENTION

The present invention relates to an adapter structure for handheld electrical tools and, more particularly, to an adapter structure that can be connected between an electrical tool and a selective tool for fastening bolts or nuts, wherein the adapter structure can provide a torque-limiting function to prevent the bolts or nuts from being damaged.

Handheld electric tools are indispensable equipment for driving fasteners, such as bolts and nuts, to fix parts to be engaged together. In use, a turning tool can be fitted into the chuck of an electrical tool so that it can be driven by the electric tool to rotate the fasteners to fix parts together. Usually, a turning tool has a hexagonal shank at one end to be easily gripped by the chuck of an electric tool and has a fastening head at the other end, which may have various forms, such as single-blade head, cross head, and hexagonal socket, so that it can rotate the fasteners to fix parts together.

Generally, an electric tool applies a certain torque to a turning tool in a fastening operation. However, in a practical application, it is quite often for an operator to keep driving the turning tool to rotate the fasteners, even the fasteners are driven to reach their ends, thereby causing damages to the fasteners, for example, damages of the single-blade head, cross head or socket head of a bolt, or causing impairment to the appearance of the parts being fixed.

BRIEF SUMMARY OF THE INVENTION

It is an objective of the present invention to provide an adapter structure that can alleviate the damages of bolts or nuts and impairment of parts due to excessive fastening, and can provide a torque-limiting function to prevent the bolts or nuts from being damaged in a fastening operation.

To achieve this and other objectives, an adapter structure of the present invention includes an outer socket and an inner socket. The outer socket, being a cylindrical housing, is provided with a shank at its bottom and provided therein with a plurality of first teeth formed on an inner wall of the outer socket. The first teeth are arranged in the form of a ring, and each tooth has two inclined faces being configured with a first slope. A receiving space is formed in a lower portion of the outer socket. The inner socket includes an upper section, a lower section, and a middle section located between the upper and lower sections. The middle section defines therein an engagement space for receiving a shank of a selective tool. The middle section is provided with a plurality of second teeth at its bottom around a top of the lower section. The second teeth correspond to the first teeth and are arranged in the form of a ring, and each tooth has two inclined faces configured with a second slope. The lower section defines therein a lower space for receiving a compression spring. The inner socket is fitted into the outer socket with the lower section thereof engaged in the receiving space of the outer socket. When the selective tool is pressed to move downwardly, the first teeth is able to be engaged with the second teeth, so that the outer socket is able to drive the inner socket together with the selective tool to rotate for conducting a fastening operation.

In an embodiment, the shank provided at the bottom of the outer socket is a hexagonal rod for ease of being gripped by a chuck of a power tool.

Furthermore, the upper section of the inner socket is provided at its wall with an engagement ball that is movable towards the engagement space of the upper section. Thus, when the shank of the selective tool is inserted into the engagement space of the upper section, the engagement ball will be engaged with an engagement slot defined in the shank of the selective tool to fix the selective tool to the inner socket.

The present invention will become clearer in light of the following detailed description of an illustrative embodiment of this invention described in connection with the drawings.

DETAILED DESCRIPTION OF THE INVENTION

Figure 1:
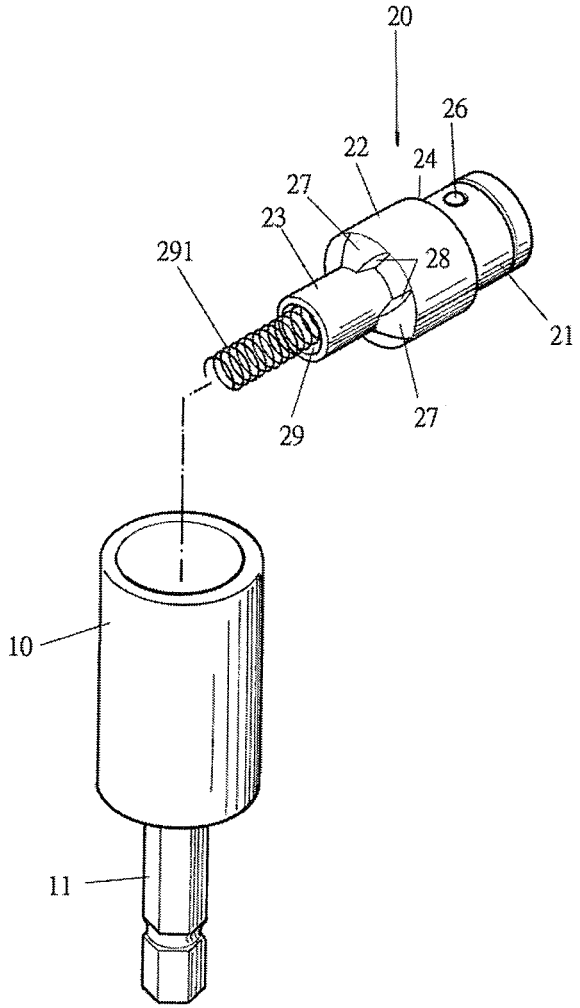
FIG. 1 is a perspective view of an adapter according to an embodiment of the present invention.
Figure 2:
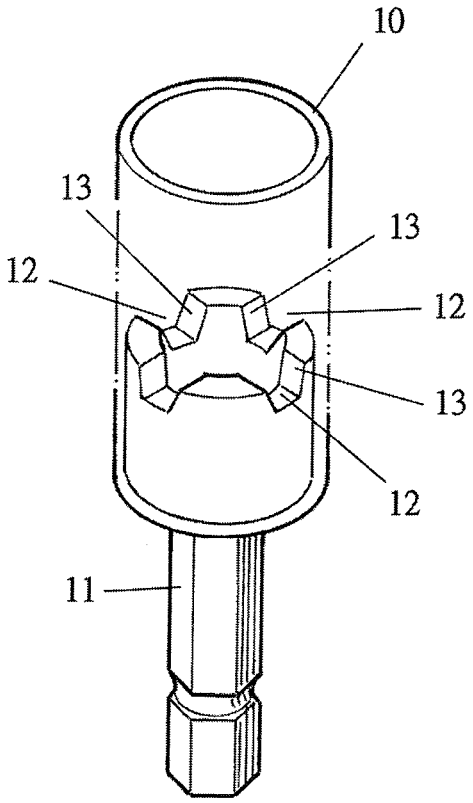
FIG. 2 shows a 3-dimesional view of an outer socket of the adapter of FIG. 1.

The accompanying drawings of the present invention are used for illustrating the basic structure of one embodiment, and thus only show the elements relating to the present invention. It should be understood that the shape, size, proportion or number of elements used in the present invention is a design choice.

The following paragraphs will illustrate the structure in detail and the effect of the embodiment of the present invention with reference to the accompanying drawings.

An adapter structure according to an embodiment of the present invention is shown in FIGS. 1 through 4 of the drawings and generally includes an outer socket 10 and an inner socket 20.

The outer socket 10, which is a cylindrical housing with an interior space and a closed bottom, is provided with a shank 11 at its bottom. The shank 11 can be a hexagonal rod for ease of being gripped by a chuck of a handheld electrical tool or other power tool. The outer socket 10 is provided therein with a plurality of first teeth 12 formed on an inner wall of the outer socket 10. The first teeth 12 are arranged in the form of a ring, and each tooth has two faces 13 being configured with a first predetermined slope. The outer socket 10 includes, at a lower portion of its interior space, a receiving space 14 located below the first teeth 12 (see FIG. 3).

The inner socket 20 includes an upper section 21, a lower section 23, and a middle section 22 located between the upper and lower sections 21 and 23, which are substantially cylindrical portions. The middle section 22 has a dimension greater than the upper section 21, and a step 24 is formed between the upper section 21 and the middle section 22. The middle section 22 defines therein an engagement space 25 for receiving a shank 31 of a selective tool 30 (see FIG. 3). The upper section 21 is provided in its wall with an engagement ball 26 that is movable towards the engagement space 25 of the upper section (see FIG. 3). As such, when the shank 31 of the selective tool 30 is inserted into the engagement space 25 of the upper section 21, the engagement ball 26 will be engaged with an engagement slot 311 defined in the shank 31 of the selective tool 30 so as to fix it to the inner socket 10. The middle section 22 is provided with a plurality of second teeth 27, corresponding to the first teeth 12, at its bottom around a top of the lower section 23, wherein the second teeth 27 are arranged in the form of a ring with each tooth having two inclined faces 28 being configured with a second predetermined slope. The lower section 23 defines therein a lower space 29 for receiving a compression spring 291.

The selective tool 30 is a widely used turning tool, which has a hexagonal shank 31 at one end thereof, and a fastening head 32 at the other end thereof, which has a variety of designs, such as cross head 321, single-blade head 322, and hexagonal socket 323 (see FIG. 3), to be suitable for fasteners being used for fixing parts together.

Figure 3:
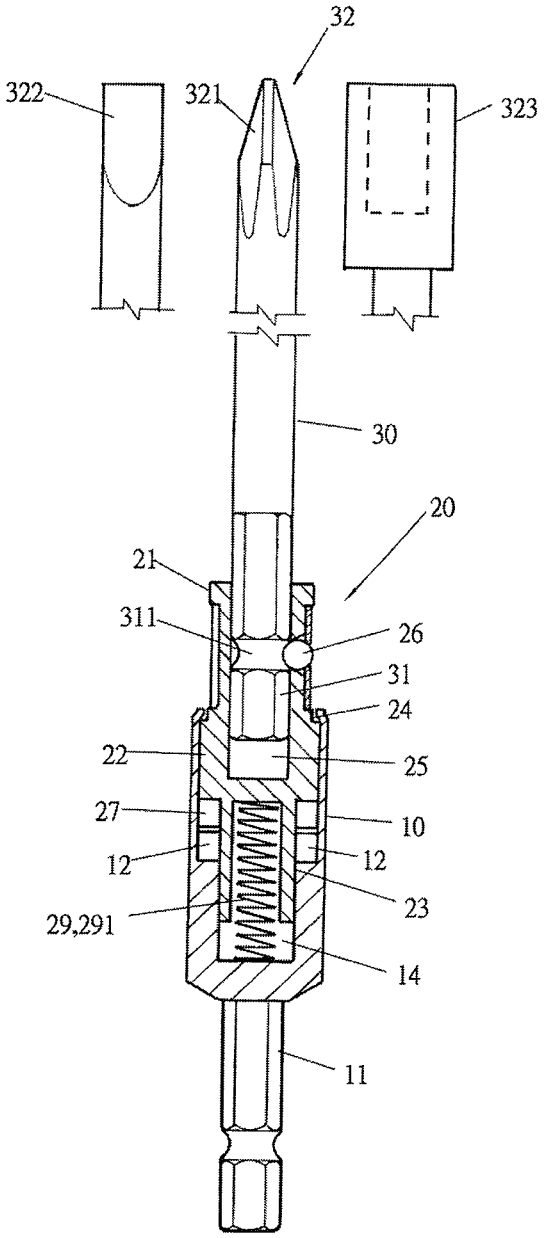
FIG. 3 shows an assembled view of the adapter of FIG. 1.

FIG. 3 shows an assembled view of the present invention, wherein the inner socket 20 is fitted into the outer socket 10 such that lower section 23 thereof is inserted into the receiving space 14 of the outer socket 10, and the second teeth 27 of the middle section 22 is placed to abut the first teeth 12 of the outer socket 10. Under this condition, the inner socket 20 can be limited by a crimp (not labeled) formed at a top edge of the outer socket 10, where the crimp is engaged with the step 24 of the inner socket 20 (see FIG. 3), so that the inner socket 20 will not be detached from the outer socket 10. Furthermore, the compression spring 291, which is inserted into the lower space 29 of the lower section 23 of the inner socket 20, is received in the receiving space 14 of the outer socket 10 and can provide a repelling force for the inner socket 20 and the outer socket 10, to cause the second teeth 27 to be normally disengaged from the first teeth 12.

Figure 4:
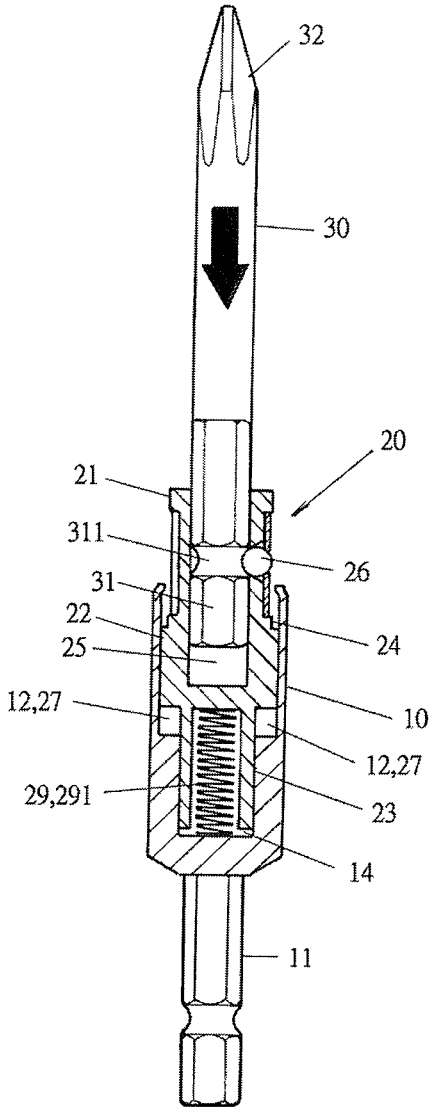
FIG. 4 shows a working view of the adapter of FIG. 1, wherein an inner socket is engaged with the outer socket in a fastening operation.
Figure 5:
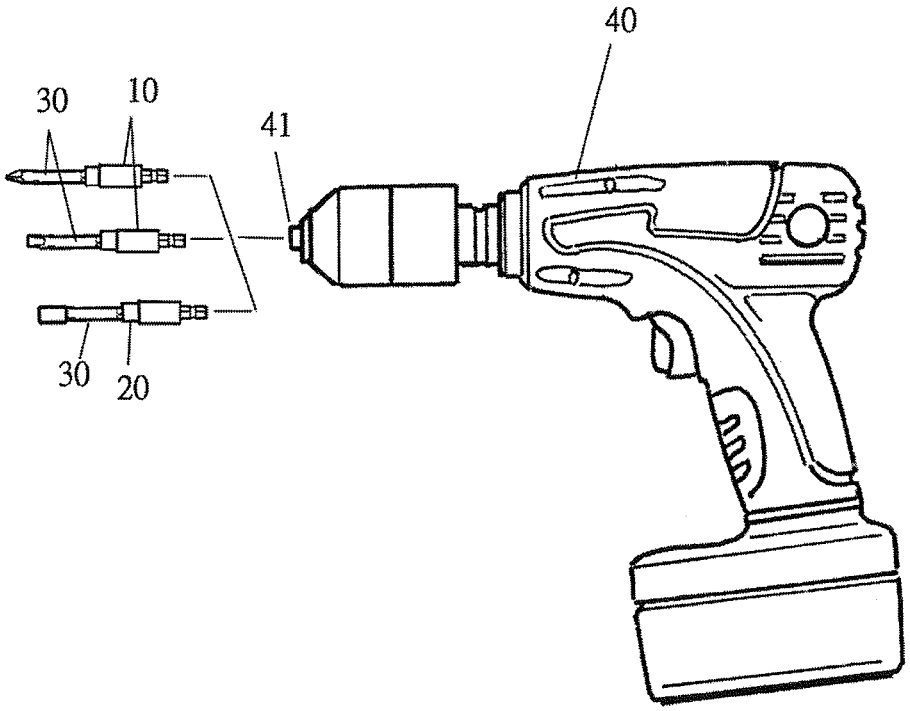
FIG. 5 shows an application view of the adapter of FIG. 1, wherein various tools can be selected to cooperate with the adapter to facilitate an electric tool to conduct a fastening operation.

Referring to FIGS. 4 and 5, the shank 11 of the outer socket 10 can be fitted into a chuck 41 of a handheld electric tool 40 (such as electric screwdriver, electric drill, etc.) while the shank 31 of the selective tool 30 can be fitted into the engagement space 25 of the upper section 21 of the inner socket 20. When a user want to fasten a bolt or nut, the user may apply a force to have the inner socket 20 moved downwardly, causing the second teeth 27 of the inner socket 20 to be engaged with the first teeth 12 of the outer socket 10. Under this condition, the electric tool 40 can rotate the outer socket 10, which in turn can drive the inner socket 20 together with the selective tool 30 to rotate, and thus the fastening end 32 of the selective tool 30 can rotate the bolt or nut to achieve the purpose of fastening parts. When the bolt or nut has been driven to its end, a greater torque will be required for the bolt or nut to keep advancing. However, under the condition where a greater torque is exerted by the electric tool 40, since the faces 13 of the first teeth 12 and the faces 28 of the second teeth 27 are configured with predetermined slopes, slippage will occur between the first teeth 12 and the second teeth 27, so that the inner socket 10 can be forced to move upwardly and thus the second teeth 27 can be disengaged from the first teeth 12, so that the inner socket 20 can be prevented from being rotated by the outer socket 10. In other words, the first and second teeth 12 and 27 can provide a torque-limiting function. Therefore, damages to the bolt or nut (such as damages of the cross head, slotted head or hexagonal head of the bolt) can be avoided, or the appearance of the parts being fixing together can be prevented from being impaired.

It is noted that the maximum torque applied to the inner socket 20 by the outer socket 10 is determined by the slopes of the faces 13, 28 in the first and second teeth 12 and 27. The ratio of the slope of the faces 13 of the first teeth 12 to the slope of the faces 28 of the second teeth 27 can be obtained through experiments. The slopes of the faces 13, 28 of the first and second teeth can be set according to the maximum torque required by users.

As a summary, the adapter structure of the present invention, including the outer socket 10 and the inner socket 20, can be applied to a handheld electric tool or other power tool in cooperation with a selective tool 30 for a fastening operation. The adapter structure of the present invention is featured in that the maximum torque transmitted between the outer socket 10 and the inner socket 20 is limited such that the fasteners, such as bolts or nuts, can be prevented form damages due to over torque, or the appearance of the parts being fixed together can be prevented from impairment due to excessive fastening. Thus, the present invention can afford an electric tool or other power tool a useful function in a fastening operation.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An adapter structure for handheld electrical tools comprising:

an outer socket, being a cylindrical housing, provided with a shank at its bottom and provided therein with a plurality of first teeth formed on an inner wall of the outer socket, with the first teeth arranged in the form of a ring, with each tooth having two inclined faces, with a receiving space formed in a lower portion of the outer socket; and an inner socket including an upper section, a lower section, and a middle section located between the upper and lower sections, with the middle section defining therein an engagement space for receiving a shank of a tool, with the middle section provided with a plurality of second teeth at its bottom around a top of the lower section, with the second teeth corresponding to the first teeth and arranged in the form of a ring, with each tooth having two inclined faces, with the lower section defining therein a lower space for receiving a compression spring;

wherein the inner socket is fitted into the outer socket with the lower section thereof engaged in the receiving space of the outer socket, wherein when the tool is pressed to move downwardly, the first teeth is able to be engaged with the second teeth, so that the outer socket is able to drive the inner socket together with the tool to rotate for conducting a fastening operation.

2. The adapter structure according to claim 1, wherein the shank provided at the bottom of the outer socket is a hexagonal rod for ease of being gripped by a chuck of a power tool.

3. The adapter structure according to claim 1, wherein the upper section of the inner socket is provided at its wall with an engagement ball that is movable towards the engagement space of the upper section, whereby when the shank of the tool is inserted into the engagement space of the upper section, the engagement ball will be engaged with an engagement slot defined in the shank of the tool to fix the tool to the inner socket.

4. The adapter structure according to claim 1, wherein the middle section has a dimension greater than the upper section, with a step formed between the upper section and the middle section, with the inner socket limited by a crimp formed at a top edge of the outer socket, with the crimp engaging with the step of the inner socket so that the inner socket will not be detached from the outer socket.

* * * * *